United States Patent [19]

Constance

[11] 4,016,673

[45] Apr. 12, 1977

[54] BUBBLE PULL TOY

[76] Inventor: Chris Constance, 1 Ramsey Road, Great Neck, N.Y. 11023

[22] Filed: May 19, 1975

[21] Appl. No.: 578,999

[52] U.S. Cl. ..... 46/6; 46/8
[51] Int. Cl.[2] ..... A63H 33/28
[58] Field of Search ..... 46/6–8

[56] References Cited

UNITED STATES PATENTS

| | | | |
|---|---|---|---|
| 2,579,714 | 12/1951 | Treuthart | 46/8 |
| 2,675,641 | 4/1954 | Baggott | 46/8 |
| 3,100,947 | 8/1963 | Hellman | 46/8 |
| 3,708,909 | 1/1973 | Winston | 46/7 |

*Primary Examiner*—Louis G. Mancene
*Assistant Examiner*—Robert F. Cutting
*Attorney, Agent, or Firm*—Caesar, Rivise, Bernstein & Cohen, Ltd.

[57] ABSTRACT

A Bubble Wheel Toy employing a thin cylindrically shaped annular surface wheel, having openings formed in the annular surface, with means to drive the wheel through a bath containing bubble solution, and air means ejecting jets of air internally of said wheel and against said wheel openings which are filled with bubble solution, while said wheel rotates whereby a stream of bubbles are formed and ejected from said toy.

3 Claims, 2 Drawing Figures

BUBBLE PULL TOY

This invention relates to a Bubble Wheel Toy where there is provided a novel means to create a continuous or intermittent stream of bubbles in conjunction with a Pull Toy. Yet another feature of the invention involves a special construction to provide the same or varying size bubbles on a continuous or intermittent basis.

Figure 1:
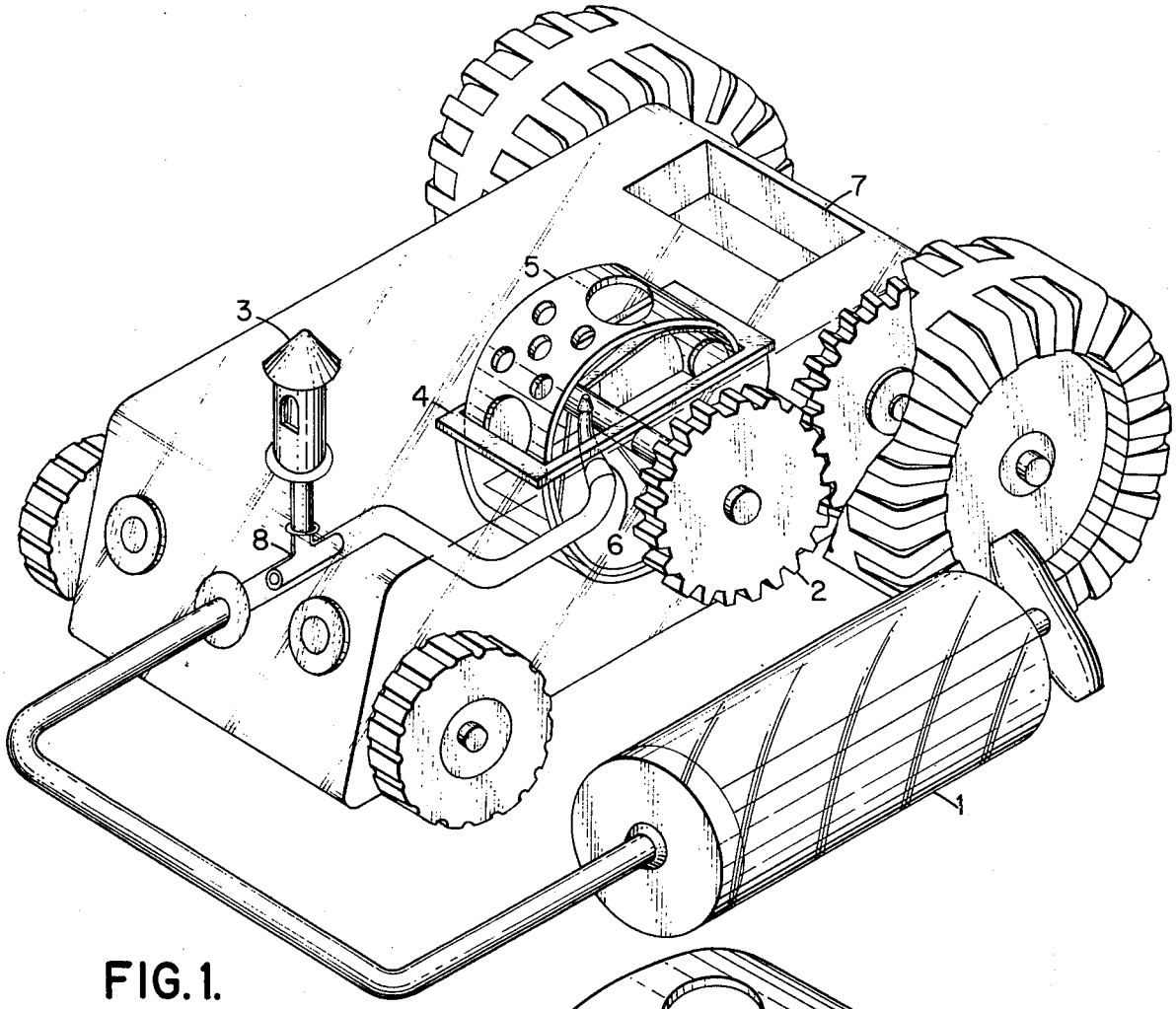
Figure 2:
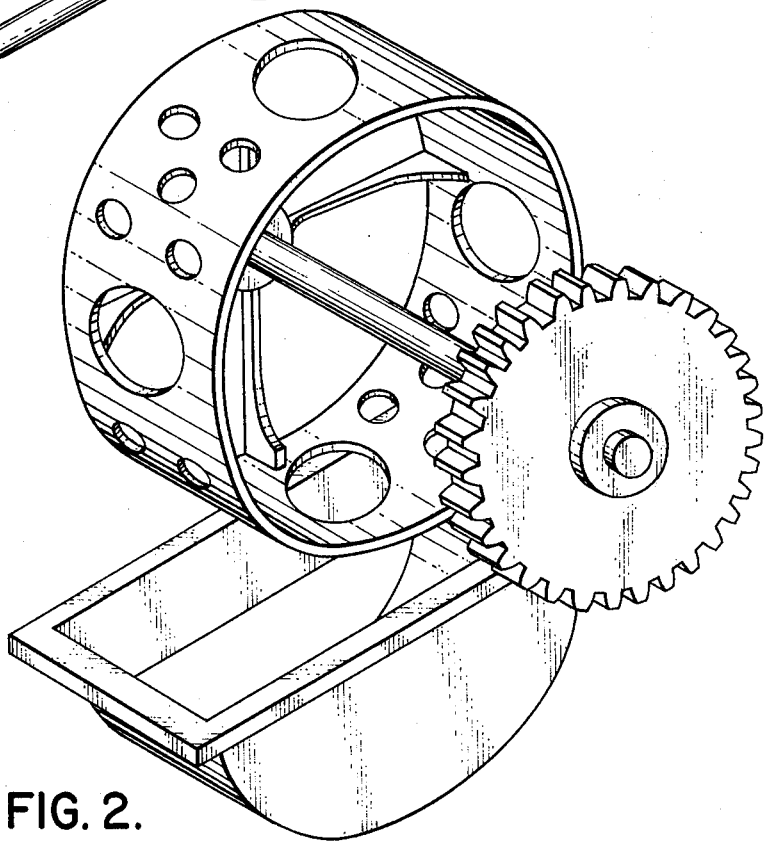

Attention is called to FIGS. 1 and 2 of the drawings wherein like reference characters refer to like parts.

FIG. 1 is a perspective view of the bubble pull toy embodying the present invention; and, FIG. 2 is an enlarged perspective view of a portion of the gear system of the bubble pull toy of this invention.

It will be seen that the Bubble Toy comprises air producing means 1 in a form of a piston that is moved within a cylinder by means of a plunger. The air thus produced travels through tubing and some of such air may be ejected through a whistle 3. The balance of the air stream flows to be ejected in jets adjacent nozzle means 6.

The body of the toy is equipped with wheels, one of which is attached to a gear which in turn drives the gear 2, to which is attached a shaft that is connected to the thin cylindrically shaped annular surface 5 which is shown in greater detail in FIG. 2.

It will be seen that the annular surface 5 constitutes a pick-up wheel because it possesses a series of openings which receive bubble solution that is maintained in tank 4.

In operation it will be appreciated that the piston-cylinder mechanism 1 (which may also be termed a pump) can be of clear plastic so that the child can see how the air pump works. The pick-up wheel 5 is driven by the motion of the wheel of the toy to gear 2 as previously discussed. If desired, the device may be fitted with front lights as well as a recessed area 7 to receive other items.

In operation, the child holds the pump 1 and pulls the toy. When desired the child pushes the the plunger of pump 1 so as to compress air which is sent through the tubing to be ejected from the nozzle 6 and then flow through solution filled openings in the wheel 5 to produce a stream of bubbles.

The Bubble Wheel Toy of this invention can be used with other motion mechanisms and so in some cases can be mechanically wound or powered by batteries.

I claim:

1. A bubble toy comprising a housing supported for movement on wheels, a cylindrically shaped thin annular wheel surface drivingly connected to one said housing wheels, said annular surface wheel comprising an annular perforated web, rotatable about a horizontal axis, said web being perforated with holes of varying size openings, said annular wheel being in contact with a bubble solution held in a bath supported on said housing, jet means on said housing and located within said wheel to supply a jet of air toward certain of said annular wheel openings in that portion of said annular wheel which has been rotated to a general horizontal position whereby said jet means causes production of a plurality of bubbles upwardly and outwardly as said annular wheel is rotated.

2. The bubble toy of claim 1 wherein said jet means is actuated by a pump device.

3. The bubble toy of claim 1 wherein one of said housing wheels includes a first gear which drives a second gear which in turn drives a shaft through which said annular wheel is connected.

* * * * *